US009892880B2

(12) United States Patent
Schmidt et al.

(10) Patent No.: US 9,892,880 B2
(45) Date of Patent: Feb. 13, 2018

(54) INSERT FOR FUSE HOUSING

(71) Applicant: LITTELFUSE, INC., Chicago, IL (US)

(72) Inventors: Florian Schmidt, Harpstedt (DE); Michael Hofmann, Bremen (DE); Pascal Jung, Bremen (DE)

(73) Assignee: Littelfuse, Inc., Chicago, IL (US)

( * ) Notice: Subject to any disclaimer, the term of this patent is extended or adjusted under 35 U.S.C. 154(b) by 0 days.

(21) Appl. No.: 15/005,787

(22) Filed: Jan. 25, 2016

(65) Prior Publication Data

US 2016/0141140 A1 May 19, 2016

Related U.S. Application Data

(63) Continuation-in-part of application No. 14/716,268, filed on May 19, 2015, now Pat. No. 9,607,799.

(60) Provisional application No. 62/001,924, filed on May 22, 2014.

(51) Int. Cl.

| | |
|---|---|
| ***H01H 85/143*** | (2006.01) |
| ***H01H 85/165*** | (2006.01) |
| ***H01H 69/02*** | (2006.01) |
| ***H01H 85/175*** | (2006.01) |
| ***H01H 85/38*** | (2006.01) |
| *H01H 85/00* | (2006.01) |
| *H01H 85/18* | (2006.01) |

(52) U.S. Cl.

CPC ..... *H01H 69/02* (2013.01); *H01H 85/143* (2013.01); *H01H 85/1755* (2013.01); *H01H 85/38* (2013.01); *H01H 85/0086* (2013.01); *H01H 85/165* (2013.01); *H01H 85/18* (2013.01); *H01H 2085/383* (2013.01); *H01H 2085/388* (2013.01); *Y10T 29/49108* (2015.01)

(58) Field of Classification Search

CPC ..... H01H 85/05; H01H 69/02; H01H 85/175; H01H 85/1755; H01H 85/38; H01H 2085/388; H01H 85/18; H01H 2085/383; H01H 85/0086; H01H 85/143; H01H 85/165; Y10T 29/49108

USPC ..... 337/186, 276, 280

See application file for complete search history.

(56) References Cited

U.S. PATENT DOCUMENTS

| | | | | |
|---|---|---|---|---|
| 550,638 A | | 12/1895 | McCulloch | |
| 1,337,357 A | * | 4/1920 | Holdorf | H01H 85/303 337/244 |
| 1,350,055 A | | 8/1920 | Ballman | |
| 1,474,146 A | * | 11/1923 | Feldkamp | H01H 85/38 337/250 |
| 1,480,225 A | * | 1/1924 | Snook | H01H 85/18 218/1 |
| 1,544,785 A | * | 7/1925 | Trumbull | H01H 85/0458 337/225 |

(Continued)

FOREIGN PATENT DOCUMENTS

| | | |
|---|---|---|
| CN | 102623273 A | 8/2012 |
| GB | 443717 A | 3/1936 |

*Primary Examiner* — Anatoly Vortman

(57) ABSTRACT

The present disclosure includes an insert for a fuse structure. In one approach, a fuse, includes a housing having a cavity, a fuse element disposed within the cavity, a plurality of terminals extending out of the housing and electrically connected to the fuse element, and an insert disposed in the cavity, the insert including a pin extending through an opening of the housing. In some approaches, the insert includes a separating wall defining first and second cavities of the insert.

16 Claims, 13 Drawing Sheets

(56) References Cited

U.S. PATENT DOCUMENTS 1,573,432 A * 2/1926 Trumbull ..... H01H 85/157 337/244
1,630,358 A * 5/1927 Sandin ..... H01H 73/30 337/244
2,077,282 A * 4/1937 Denault ..... H01B 7/295 174/102 P
2,143,037 A * 1/1939 Smith, Jr. ..... H01H 85/42 337/231
2,271,729 A * 2/1942 Baldwin ..... H01H 85/303 337/267
2,419,250 A * 4/1947 Brus ..... H01H 85/157 337/235
2,483,577 A 10/1949 Fahnoe
3,190,987 A * 6/1965 Fister ..... H01H 85/20 337/206
3,281,557 A * 10/1966 Fister ..... H01H 85/303 337/244
3,317,689 A * 5/1967 Saudicoeur ..... H01H 69/02 337/246
3,317,690 A * 5/1967 Hollmann ..... H01H 69/02 337/246
3,365,559 A 1/1968 Sherwood
3,601,737 A 8/1971 Baird
3,657,679 A * 4/1972 Wilson ..... H01H 85/303 337/158
3,818,409 A 6/1974 Pastors et al.
4,100,523 A 7/1978 Arikawa et al.
4,109,228 A 8/1978 Wycklendt et al.
4,417,226 A 11/1983 Asdollahi et al.
4,506,310 A 3/1985 Schwarz
4,757,296 A 7/1988 Brown et al.
4,789,512 A 12/1988 Hughes
5,095,297 A 3/1992 Perreault et al.
5,113,169 A * 5/1992 Ruehl ..... H01H 85/303 337/265
5,179,436 A 1/1993 Asdollahi et al.
5,357,234 A * 10/1994 Pimpis ..... H01H 85/153 29/623
5,418,515 A * 5/1995 Reyes ..... H01H 85/303 337/206
5,420,560 A 5/1995 Hanada
5,854,583 A * 12/1998 Falchetti ..... H01H 85/044 337/159
7,639,112 B2 * 12/2009 Nicoletti, III ..... H01H 9/10 337/148
2011/0279218 A1 11/2011 Salonga et al.
2015/0357143 A1 12/2015 Retardo et al.
2016/0064173 A1 3/2016 Bukacek et al.

* cited by examiner

INSERT FOR FUSE HOUSING

RELATED APPLICATIONS

This application is a continuation-in-part of U.S. patent application Ser. No. 14/716,268, filed May 20, 2015, which claims priority to U.S. provisional patent application No. 62/001,924, filed May 22, 2014, each of which is incorporated by reference herein in its entirety.

FIELD OF THE DISCLOSURE

This disclosure relates generally to the fuses and particularly to inserts for use in a fuse housing.

BACKGROUND OF THE DISCLOSURE

Fuses are commonly used as circuit protection devices. A fuse can provide electrical connections between sources of electrical power and circuit components to be protected. One type of fuse includes a fusible element disposed within a hollow fuse body. Conductive terminals may be connected to different ends of the fusible element through the fuse body to provide a means of connecting the fuse between a source of power and a circuit component.

Upon the occurrence of a specified fault condition in a circuit, such as an overcurrent condition, the fusible element of a fuse may melt or otherwise separate to interrupt current flow in the circuit path. Portions of the circuit are thereby electrically isolated and damage to such portions may be prevented or at least mitigated.

As a fuse element melts, material of the element vaporizes and can deposit inside the fuse housing. This can lead to a low resistance current path between the fuse terminals. Said differently, even when the fuse element has melted and/or separated, the fuse terminals may still be electrically connected via a low resistance through the deposits of the vaporized fuse element on the inside of the fuse housing. These low resistance electrical paths are often referred to as "carbon bridges." As will be appreciated, carbon bridges can allow leakage current to flow between the fuse terminals. As such, when a carbon bridge forms, the fuse does not provide enough insulation resistance to protect the circuit components. Furthermore, as circuit voltage increases, so does the chance or occurrence of carbon bridges. In particular, owing to the high energetic light arc occurring when high voltage fuse elements vaporize, the occurrence of carbon bridges also tends to increase.

As will be appreciated, carbon bridges, and particularly the resulting leakage current, can damage circuit components intended to be protected by the melting of the fuse element. Accordingly, having a high insulation resistance in a fuse after melting of the fuse element is useful. In particular, some standards exist specifying insulation resistance to be greater than a specific value (e.g., >1 MΩ after melting at 70V, or the like) in order for the fuse to be compliant with the standard.

BRIEF SUMMARY

In one embodiment, a fuse includes a housing having a cavity, a fuse element disposed within the cavity, a plurality of terminals extending out of the housing and electrically connected to the fuse element, and an insert disposed in the cavity, the insert including a pin extending through an opening of the housing.

In another embodiment, a method of forming a fuse includes providing a fuse structure comprising a fuse element and a first terminal and a second terminal connected to the fuse element, providing a first housing part and a second housing part, providing an insert about the fuse element and between the first housing part and the second housing part, wherein the insert includes a pin extending through an opening of one or more of the first housing part and the second housing part, and coupling the first housing part to the second housing part, wherein the first housing part and the second housing part define a cavity retaining the insert therein.

In yet another embodiment, a fuse includes a housing having a cavity, a fuse element disposed within the cavity, a plurality of terminals extending out of the housing and electrically connected to the fuse element, and a silicone insert disposed in the cavity, the insert including a first cavity and a second cavity separated by a separating wall.

BRIEF DESCRIPTION OF THE DRAWINGS

By way of example, specific embodiments of the disclosed device will now be described, with reference to the accompanying drawings, where.

DETAILED DESCRIPTION

In general, the present disclosure provides a fuse having a housing disposed around a fuse element. The fuse further includes a porous material (e.g., silicone foam, or the like) disposed in the housing adjacent to the fuse element. During vaporization of the fuse element, portions of the vaporized fuse element may be captured in the pores of the porous material to prevent formation of carbon bridges. More specifically, the vaporized portions of the fuse element may be lodged in the pores of the porous material and thereby prevented from settling on the inside of the fuse housing and forming carbon bridges. As such, fuses according to the present disclosure may be provided having high insulation resistance (e.g., >1 MΩ at 70V for a 48V fuse, or the like) after melting of the fuse element. The example insulation resistance value given above is for purposes of clarity and completeness and is not intended to be limiting.

Figure 1:
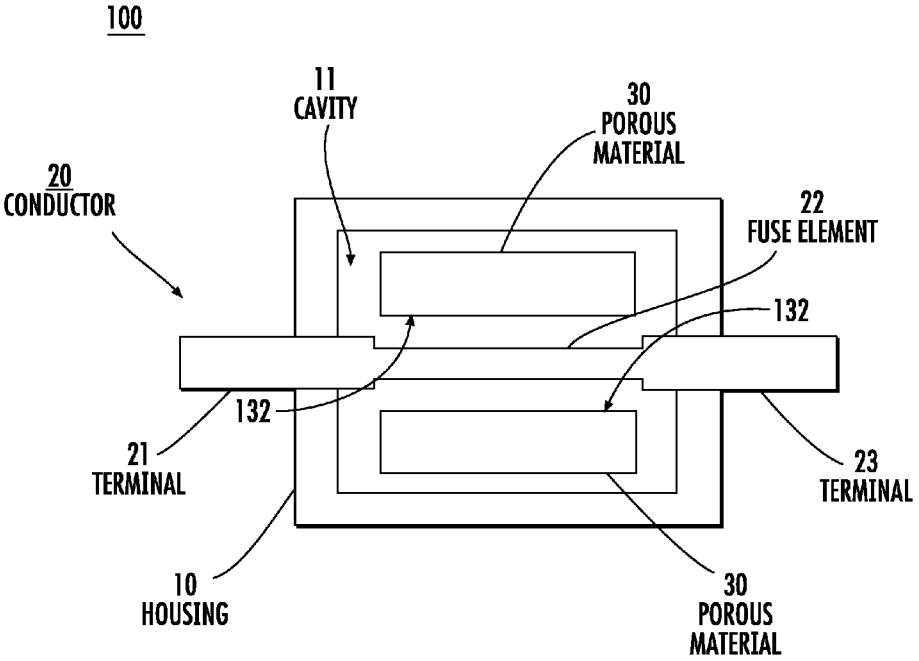
FIG. 1 is a block diagram of a fuse according to embodiments of the present disclosure.

FIG. 1 is a block diagram of a fuse 100 according to embodiments of the present disclosure. As depicted, the fuse 100 includes a housing 10, a conductor 20 and porous material 30. In general, the conductor 20 may be made from a variety of conductive materials (e.g., copper, tin, silver, zinc, aluminum, alloys including such materials, or some combination of these). Furthermore, the conductor includes a terminal 21 and a terminal 23. The terminals 21, 23 are configured to electrically connect the fuse to a source of power (not shown) and a circuit component to be protected (not shown). The terminals 21, 23 are electrically connected by a fuse element 22. In some examples, the terminals 21, 23 and the fuse element 22 may be made from the same material. In some examples, the terminals 21, 23 and the fuse element 22 may be made from different materials. Furthermore, various techniques exist for forming the conductor 20 and/or the terminals 21, 23 and the fuse element 22 (e.g., stamping, cutting, or the like). Furthermore, in the example where the terminals 21, 23 and the fuse element 22 are formed separately, the fuse element 22 and terminals 21, 23 can be joined using a variety of techniques (e.g., soldering, welding, or the like).

The porous material 30 may be a variety of porous materials configured to "catch" or "retain" portions of the fuse element 22 when the fuse element 22 vaporizes due to an overcurrent and/or overvoltage condition. In some examples, the porous material 30 may be silicone foam. In another example, the porous material 30 may be pumice. In some examples, the porous material 30 may be selected based on a variety of factors. For example, the porous material 30 may be selected based on the temperature resistance of the material. In particular, a high temperature resistance material may be useful to resist damage due to exposure to heat generated by the fuse element during normal operation and well as when the element melts. For example, the expected life span of the fuse and the temperature resistance of the material may be used to ensure the porous material 30 does not age prematurely. Additionally, the porous material 30 may be selected based on the flexibility of the material, such as, to allow the material to act as a damper and/or reduce emissions (e.g., vaporized material pushed out of the fuse housing).

In various embodiments, and as shown in particular in FIGS. 3, 4, 6, and 7 to follow, the porous material 30 may have an open pore structure, meaning at least some pores of porous material 30 are disposed on an outer surface(s) of the porous material. In particular, at least some pores may be disposed on the outer surface 132 of a piece of porous material 30 facing the fuse element 22. In this manner, the porous material 30 may present open pores directly facing the fuse element 22. As further detailed below, the porous material 30 may be disposed adjacent the fuse element 22, may be in contact with the fuse element 22, or may be spaced apart from the fuse element 22. In these different configurations pores of the porous material 30 facing the fuse element 22 or proximate the fuse element 22 may receive and retain vaporized or melted portions of the fuse element 22. In various embodiments, the porous material 30 may be disposed as an insert or inlay within a housing of a fuse or may be molded within a housing of the fuse.

In particular, the porous material 30 is configured to provide a large surface area to catch or retain the vaporized portions of the fuse element 22. Said differently, due to the pores (refer to FIG. 3) of the porous material 30, a large surface area relative to the inside surface of the housing 10 or the volume of the fuse element 22 is provided. In other words, the surface area of the porous material 30 may be larger than the surface area of the inside surface of the housing 10. As such, vaporized portions of the fuse element 22 may enter pores of the porous material 30 and may be distributed over the large surface area provided by the porous material 30 to increase the insulation resistance of the fuse 100 after melting of the fuse element 22. More specifically, the larger surface area of the porous material 30 provides a significantly larger area for vaporized portions of the fuse element 22 to be distributed and disposed. As such, the occurrence of carbon bridges may be reduced.

As depicted, the housing 10 includes a cavity 11 where the fuse element 22 and the porous material 30 are disposed. The terminals 21, 23 extend through the housing and are electrically connected to the fuse element 22. In general, the housing 10 may be made from a variety of materials (e.g., plastic, composite, epoxy, or the like). In some examples, the housing 10 may be formed around the conductor 20 and the porous material 30. In some examples, the housing 10 may be multi-part (e.g., refer to FIGS. 2, 4) and the fuse 100 can be assembled by connecting the housing parts once the conductor 20 and the porous material 30 are placed in the cavity 11.

During normal operation, current flows from terminal 21 to terminal 23 through the fuse element 22 (or vice versa). During an abnormal condition, when the fuse element 22 melts, an arc is generated and the fuse element 22 is vaporized. The porous material 30 may be configured and/or selected to flex and or absorb some of the pressure created during the melting of the fuse element 22. More specifically, as the arc burns and vaporizes the fuse element 22, pressure within the housing 10 increases. Known fuses may be prone to rupture due to such pressure. In accordance with various embodiments of the disclosure, a flexible porous material may provide for the absorption of some of the pressure created when the arc burns to reduce and/or prevent rupture of the housing 10 due to the melting of the fuse element 22. In some examples, as stated above, silicone foam may be used as the porous material 30. In particular, silicone foam may provide for the porous material 30 not to degrade during the expected life span of the fuse 100. In other words, the porous material 30 may retain sufficient flexible properties and open pores to absorb and catch vaporized material from the fuse element 22 to prevent or reduce carbon bridges. An additional advantage of silicone foam is because the silicone foam may contain little or no carbon, wherein even in the event the silicone foam decomposes during a fuse event, carbon material is not formed from the foam.

Figure 2:
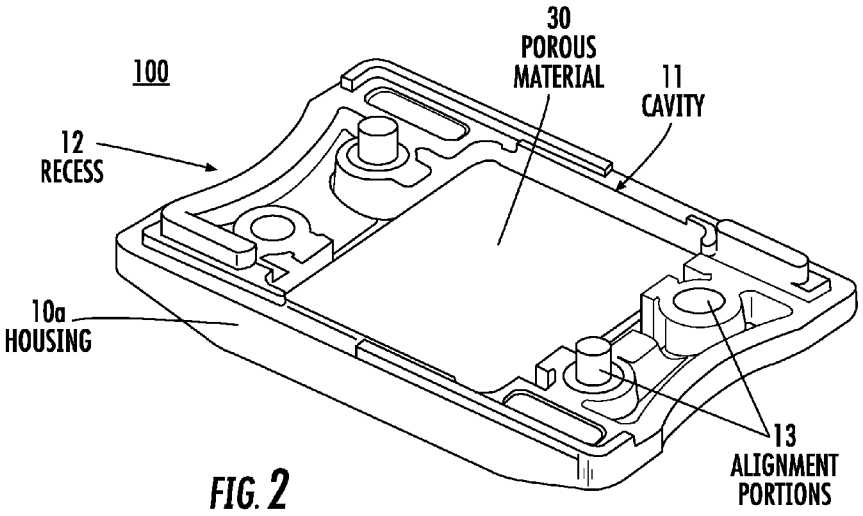
FIG. 2 is a perspective view of an example portion of a housing of the fuse of FIG. 1 according to embodiments of the present disclosure.

As described above, the housing 10 may be multiple parts, where the multiple parts are assembled to form the fuse 100. FIG. 2 illustrates an example of a top (or bottom) portion of the housing 10, referred to as housing 10*a*. As depicted, the housing 10*a* includes a cavity 11, where porous material 30 may be disposed. Furthermore, the housing 10*a* includes recessed portions 12. The recessed portions 12 may be configured to allow the terminals 21, 23 to pass through the housing 10 when the housing 10 is assembled. More specifically, when the housing 10*a* is assembled with another housing 10*a* (refer to FIG. 4) the recessed portions 12 may allow the terminals 21, 23 to extend out of the housing 10 to facilitate electrical connection of the fuse 100 to a power source and circuit component.

At least one housing 10*a* may include an alignment component configured to couple to another housing 10*a*. In particular, the housing 10*a* may also include alignment portions 13. As can be seen, the alignment portions 13 are configured to align with one another (e.g., when the housing 10*a* is assembled with another housing 10*a*). The alignment portions 13 may be configured to snap together, and or provide space for epoxy, or the like to be used to secure the housing 10 once assembled. In some examples, the alignment portions 13 may be posts and holes (e.g., as depicted in FIG. 2). In other examples, the alignment portions may be rectangular or polygonal shaped protrusions with corresponding slots or receiving holes.

Figure 3:
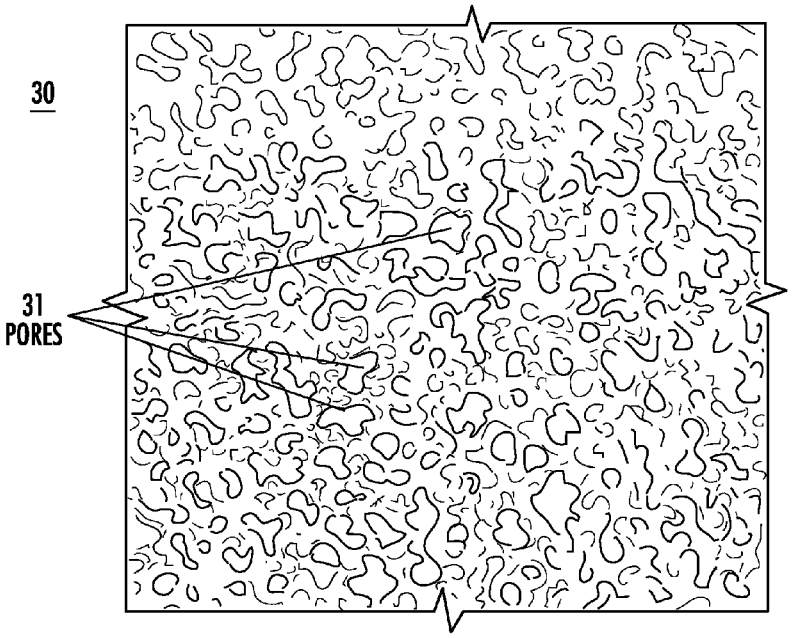
FIG. 3 is an image of an example porous material of the fuse of FIG. 1 according to embodiments of the present disclosure.

FIG. 3 illustrates an example of porous material 30 according to an embodiment of the present disclosure. The porous material 30 includes pores 31. As described above, the pores 31 are configured to increase the surface area available to catch vaporized material of the fuse element 22. In particular, the pores 31 are configured to catch the vaporized material and prevent the material from passing through the porous material and from being disposed on inner surface (inside surface) of the fuse housing, i.e., the housing 10, where the vaporized material if disposed on the inside surface could lead to a carbon bridge being formed and reduced insulation resistance once the fuse element 22 has melted. Said differently, the pores 31 are configured to trap and or retain the vaporized particles (e.g., refer to FIG. 5*b*) of the fuse element 22 in the event the fuse element 22 melts.

Figure 4:
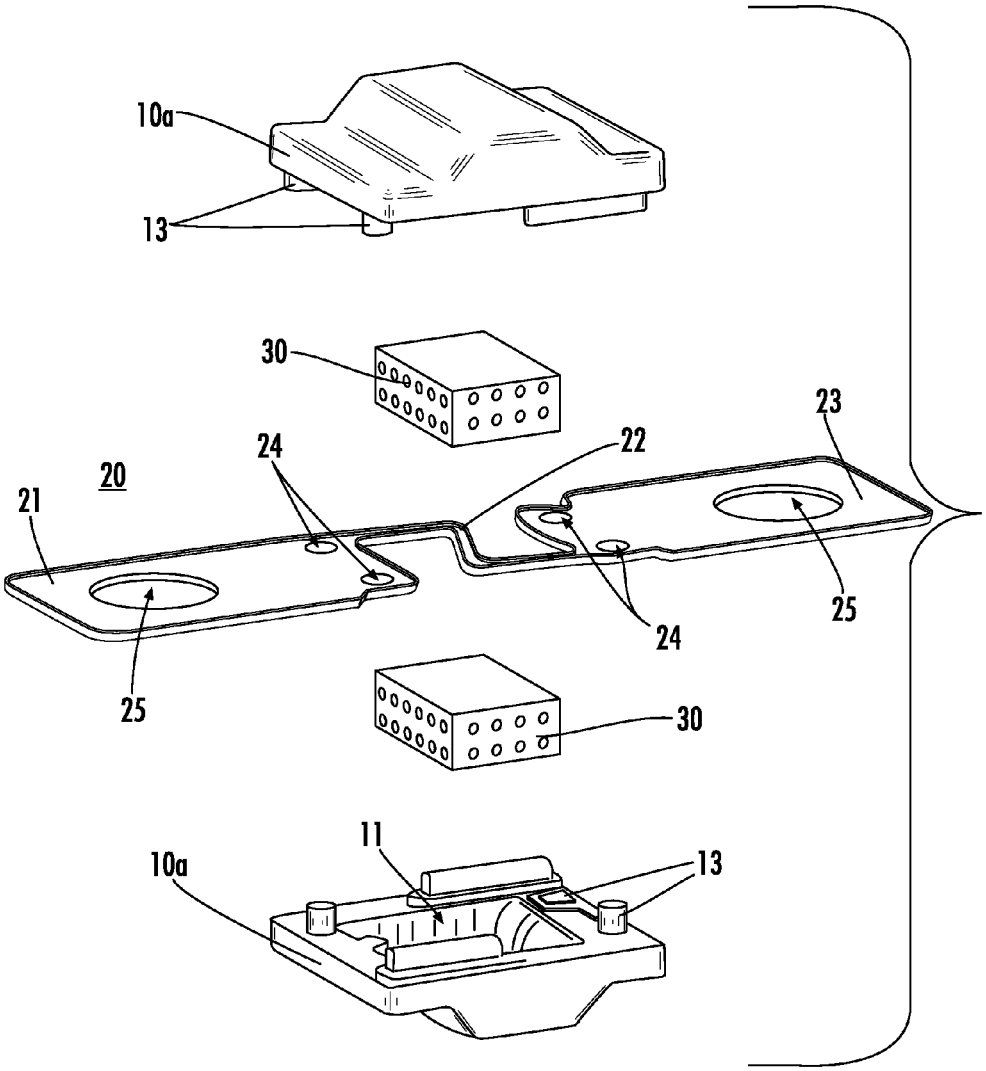
FIG. 4 is an exploded perspective view of an example of the fuse of FIG. 1 according to embodiments of the present disclosure.

FIG. 4 illustrates an exploded view of the fuse 100 according to embodiments of the present disclosure. As depicted, the fuse 100 includes housing 10*a*, porous material 30, and conductor 20. The conductor 20 includes the terminals 21, 23 and the fuse element 22. In some examples, the terminal 21 and terminal 23 may have a connection hole 25. The connection hole 25 may be configured to physically and electrically connect the fuse 100 to a source of power and circuit component. For example, the holes 25 may be configured so the fuse 100 can be secured to a bolt or post. Furthermore, the conductor 20 may have alignment holes 24. The alignment holes 24 may be configured to align with the alignment portions 13 of the housings 10*a* as the fuse 100 is assembled. The alignment holes 24 and alignment portions 13 can then retain the housing 10 over the fuse element 22 once the fuse 100 is assembled. Additionally, the alignment portions 13, when passed through the alignment holes 24 may form a structure retaining the porous material 30 centered over the fuse element 22. This may assist in ensuring substantially all or as much as desired of the vaporized material from the fuse element 22 is caught in the pores 31 (refer to FIG. 3) when the fuse element 22 melts.

In some examples, the porous material 30 may be disposed so the porous material is touching the fuse element 22. With other examples, the porous material 30 may be disposed so a space (e.g., refer to FIGS. 1 and 7) exists between the terminals 21, 23 and the porous material 30. More specifically, a space exists between the terminals 21, 23 and the porous material 30 so a carbon bridge is unlikely to build up and provide a low resistance path between terminals 21, 23. With some examples, a space between terminals 21, 23 and the porous material 30 may exist, while the porous material 30 is close to or even touches the fuse element 22.

With some examples, the porous material 30 may be configured to cool the arc during melting of the fuse element, in addition to catching vaporized material. Accordingly, the fuse 100, in addition to providing higher insulation resistance, may provide quicker arc extinction than conventional fuses.

Figure 5A:
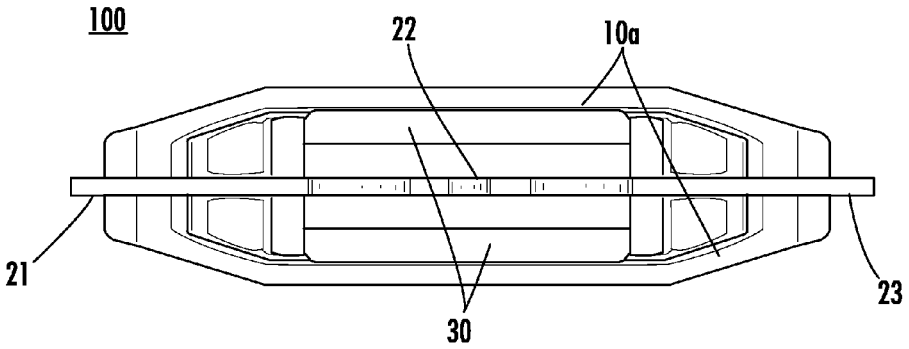
FIGS. 5*a*-5*b* are cut-away views of an example of the fuse of FIG. 1 before and after the fuse element melts according to embodiments of the present disclosure.
Figure 5B:
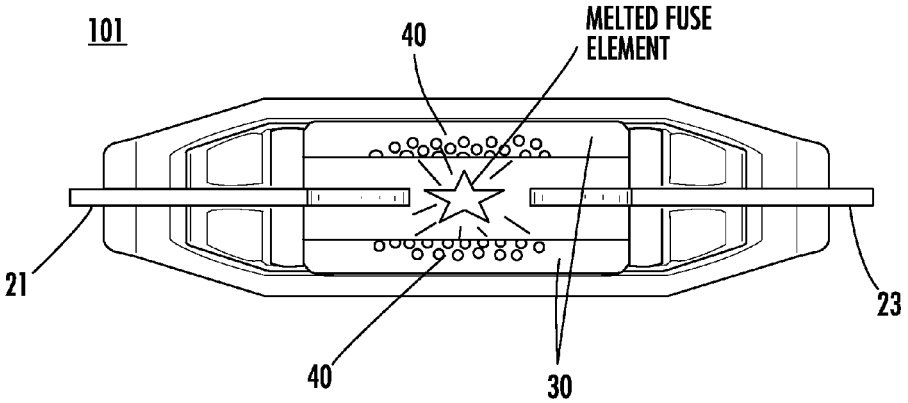

FIGS. 5*a*-5*b* illustrate a cut-away view of an example fuse, fuse 100, before and after the fuse element melts. In particular, FIG. 5*a* illustrates the fuse 100 before the fuse element 22 has melted while FIG. 5*b* illustrates the fuse 100' once the fuse element 22 has melted. As depicted, the porous material 30 is disposed in the cavity 11 of the housing 10 above and below the fuse element 22. Furthermore, the porous material 30 is centered about the fuse element 22. Terminals 21, 23 extend out from the housing 10 and provide a path for current to flow through the fuse element 22.

Once an overcurrent and/or overvoltage condition occurs, the fuse element 22 melts and vaporizes as described above. The porous material 30 catches the vaporized material 40 of the fuse element 22. In particular, the vaporized material 40 is lodged in the pores 31 of the porous material 30 and is thereby substantially prevented from depositing on the inside surface of the housing 10. Accordingly, the path for current to flow between the terminals 21, 23 is interrupted and a high (e.g., >1 MΩ for a 70V fuse, or the like) insulation resistance is provided.

In various embodiments, the porous material 30 is provide with a pore structure capturing vaporized material 40 in a manner reducing the likelihood of formation of a continuous electrically conductive path between the terminal 21 and terminal 23 after a fusing event. The porous material 30 may have a pore size distribution adapted to contain solidified particles (referred to as the vaporized material 40) formed after solidification of melted or vaporized portions of the fuse element 22. For example, the pore size of porous material 30 may range from several micrometers to several millimeters, such as between between five micrometers and five millimeters. Additionally, the porous material 30 may have a surface area five times greater than the surface area of the inside of housing 10, or ten times greater, or one hundred times greater. For a given amount of vaporized material 40, this structure of porous material 30 provides a much larger surface area to condense upon without forming a continuous layer or bridge of conductive material, as compared to a fuse formed without the porous material 30.

Figure 6:
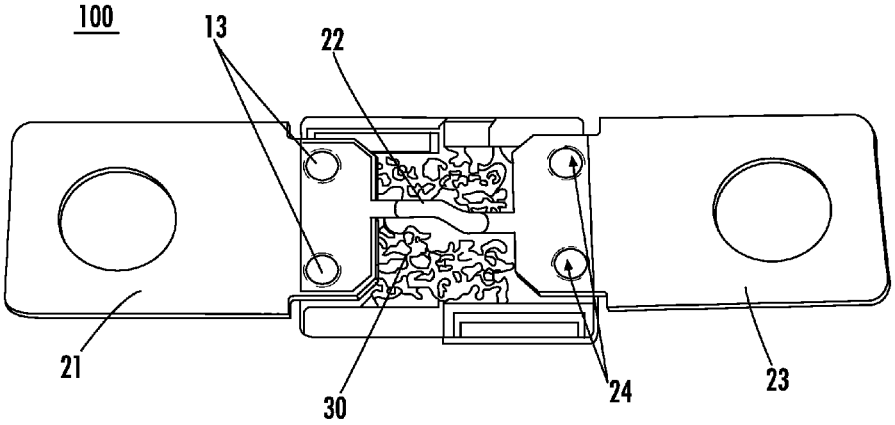
FIG. 6 is an image of an example of the fuse of FIG. 1 according to embodiments of the present disclosure.

FIG. 6 is an image of an example fuse, fuse 100, according to embodiments of the present disclosure. As depicted, terminals 21, 23 are connected to the fuse element 22 and extend out of the housing 10*a*. The alignment holes 24 are fit over the alignment portions 13 of the housing 10*a* and are configured to receive the alignment portions 13 (not shown) of another housing 10*a* (also not shown) to be assembled on the housing 10*a*. Furthermore, the porous material 30 is depicted disposed below the fuse element 22 and retained in position (e.g., substantially centered over the fuse element 22) by the alignment portions 13. In some examples, another piece of porous material 30 (not shown for clarity of illustration) may be disposed above the fuse element 22 and retained in position opposite the porous material 30 shown in FIG. 6.

Figure 7:
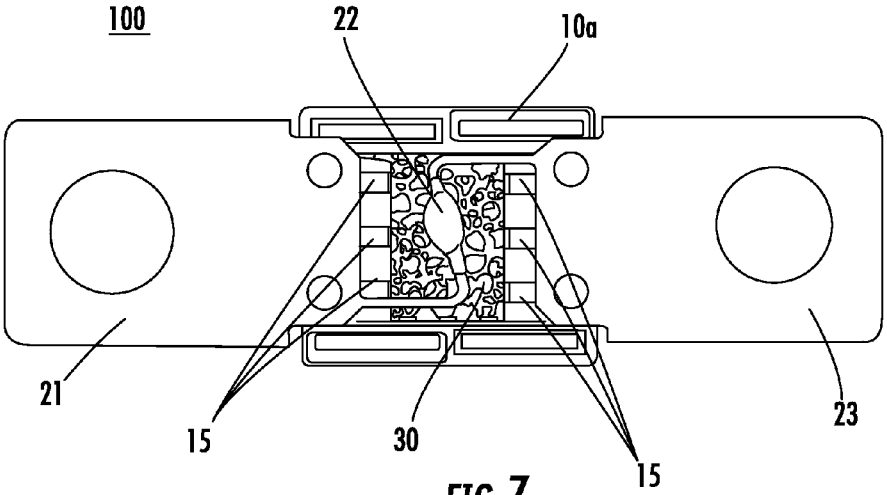
FIG. 7 is an image of an example of the fuse of FIG. 1 according to embodiments of the present disclosure.

FIG. 7 is an image of an example fuse, fuse 100, according to embodiments of the present disclosure. As depicted, the terminals 21, 23 are connected to the fuse element 22 and extend out of the housing 10*a*. The porous material 30 is inserted into the cavity 11 of the housing 10*a* between ribs 15. As depicted, the ribs 15 are positioned on either side of the porous material 30. In general, the ribs 15 may have any of a variety of shapes (e.g., ribs as shown, circular posts, or the like). The ribs 15 may be configured to support the porous material 30 during assembly (e.g., retain the material in the cavity 11) as well as support the porous material 30 after assembly and during use. In particular, where the porous material 30 is a flexible material, the porous material 30 may be sized slightly larger than the distance between the ribs. As such, when the material is inserted between the ribs, the material may be biased to push against the ribs and thereby be retained in the cavity. With some example, the porous material 30 may be spaced away from the terminals 21, 23 to prevent a carbon bridge from forming on the surface of the porous material 30 itself and providing a low resistance path between the terminals 21, 23.

In some examples, the housing 10*a* may have ribs forming a rectangular box or bed. The rectangular bed may be sized slightly smaller than the porous material 30, such as when the porous material is in an uncompressed state before assembly in the fuse 100. The porous material 30 can be compressed and inserted into the rectangular bed. Due to the characteristic of the porous material 30, during assembly in the fuse 100, the porous material may be biased to expand against the rectangular bed and thereby be retained in the rectangular bed during assembly and use.

Figure 8A:
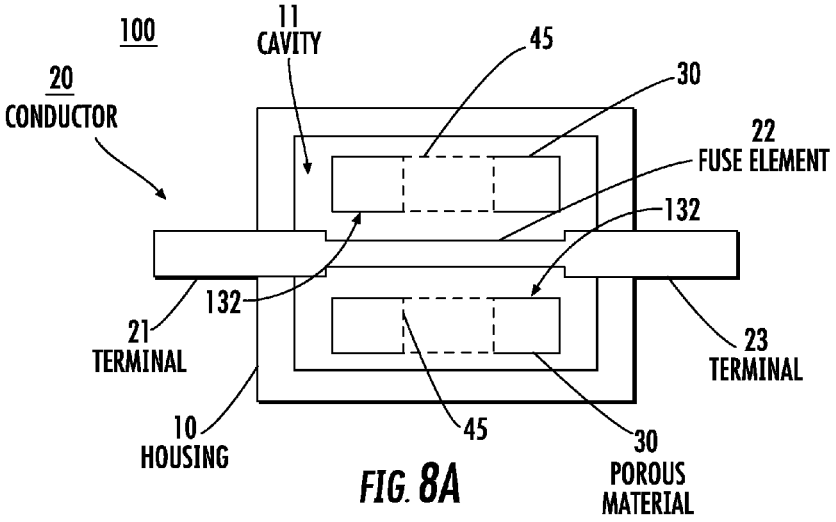
FIG. 8A is a block diagram of another embodiment of a fuse shown in a side view as in FIG. 1.
Figure 8B:
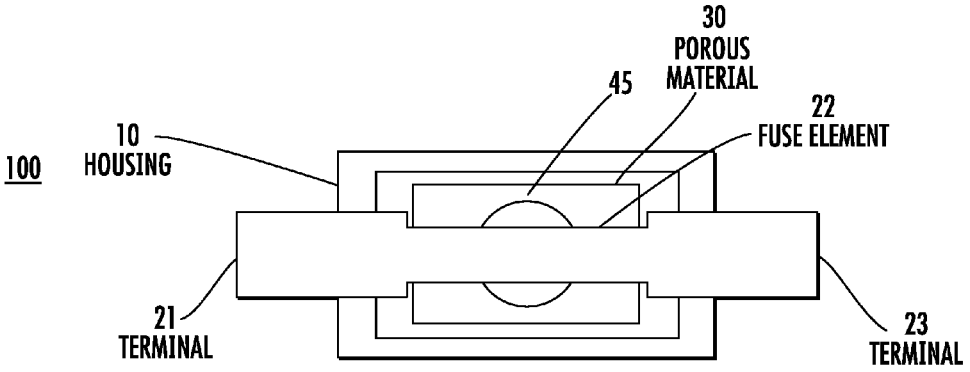
FIG. 8B is a block diagram of the fuse of FIG. 8A in top plan view, with a top piece of porous material removed for clarity.

FIG. 8A is a block diagram of another embodiment of fuse 100 shown in a side view as in FIG. 1. FIG. 8B is a block diagram of fuse 100 of FIG. 8A in top plan view, with a top piece of porous material 30 removed for clarity. In this embodiment, the fuse 100 may be similar to the embodiment of fuse 100 of FIG. 1, with a difference being the porous material 30 includes a hole 45. The hole 45 may be disposed facing the fuse element 22 and in particular a middle region where melting and or vaporization may take place during a fusing event. According to various embodiments, providing a depression, cavity, or hole within a porous material may be useful to increase capture of vaporized or melted material. In the embodiment of FIG. 8A, the hole 45 may extend through the thickness of porous material 30. In other embodiment, a depression may extend partially through the thickness of porous material 30. The embodiments are not limited in this context. The shape of the hole 45 may be circular, square, rectangular, or other convenient shape. In various embodiments, the diameter or other lateral dimension of the hole 45 may be 2 mm to 10 mm. An advantage of the embodiment of FIGS. 8A and 8B is because a depression or hole may be reproducibly located at a target location near where melting or vaporization of a fuse element 22 may take place. Thus, in addition to material captured by pores of the porous material 30, material is likely captured within hole 45 during a fusing event.

Turning now to FIGS. 9-12B, a fuse insert according to another exemplary embodiment will be described in greater detail. As shown, a fuse 200 includes a housing 210 having a cavity 214 formed therein, and a fuse element 216 disposed within the cavity 214. The fuse 200 further includes a plurality of terminals 218A-B extending out of the housing 210 and electrically connected to the fuse element 216. The fuse 200 further includes an insert 220 disposed within the cavity 214. As shown, the plurality of terminals 218A-B includes first and second terminals, wherein the insert 220 is spaced apart/between the first and second terminals 218A-B.

In one embodiment, the insert 220 is a silicone material, as the insert 220 is in direct touch with the melting fuse element 216, which becomes hot (e.g., 170° C. and higher) during overload conditions. As further shown, the insert 220 includes a pin 224 configured to extend through an opening 228 formed through the housing 210. During assembly, the pin 224 is inserted through the opening 228 in one or both portions of the housing 210, and serves as a visual indicator that the insert 220 is contained within the fuse 200.

In some embodiments, the pin 224 may include an orifice 227 formed therein as a pressure release feature. For example, during an arcing event, high pressure is built up inside the housing 210 and/or insert 220. In the case where the pressure exceeds the capability of the housing 210 and/or insert 220, the orifice 227 is formed in the silicone that enables venting of the inner cavity to prevent the housing 210 from being damaged. In some embodiments, the orifice 327 may be pre-formed through the pin 324, e.g., as a narrow channel that is closed in a normal state, expanding as pressure increases. In other embodiments, the orifice 327 is not preformed and, instead, is formed by virtue of the pin 324 rupturing as it expands through the opening 328 of the housing 310. The pin 324 may be dimensioned, e.g., with a particular sidewall thickness, to ensure that failure occurs at an intended pressure level.

Figure 9:
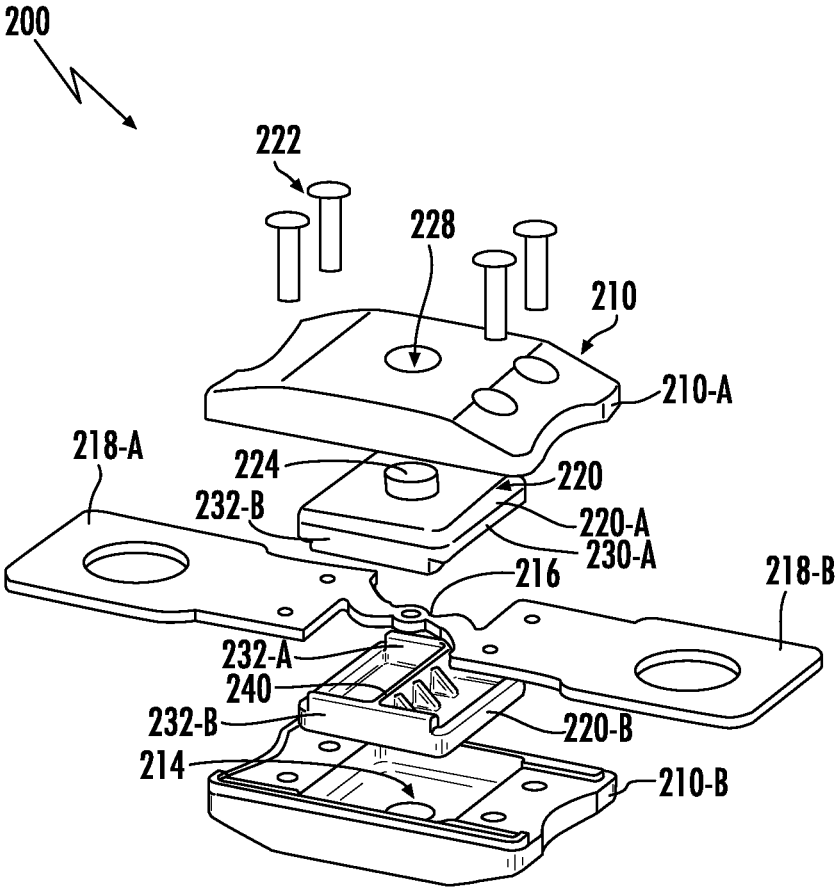
FIG. 9 an exploded perspective view of an example fuse structure according to embodiments of the present disclosure.
Figure 10A:
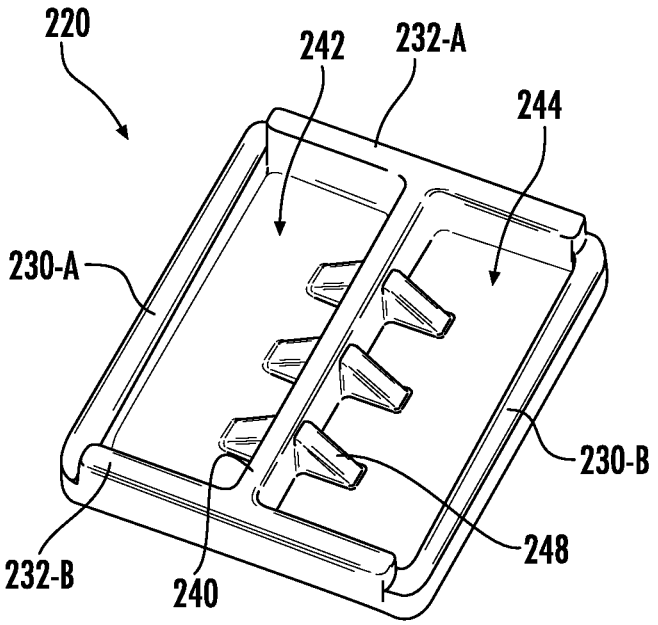
FIG. 10A is a top perspective view of an insert for use with a fuse according to embodiments of the present disclosure.
Figure 10B:
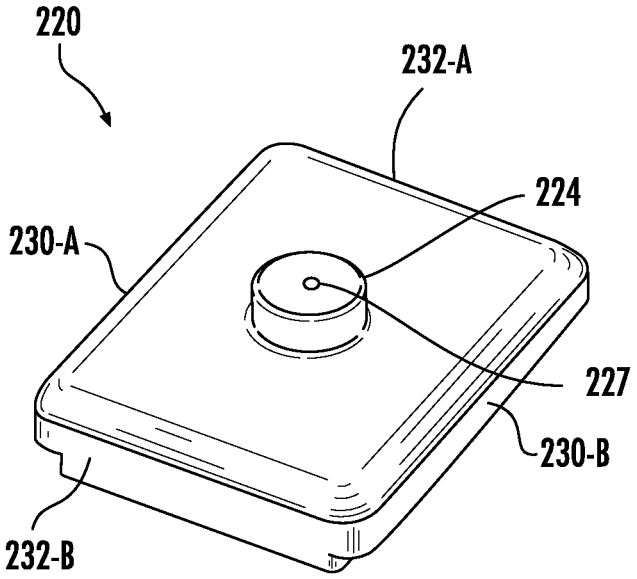
FIG. 10B is a bottom perspective view of the insert of FIG. 10A according to embodiments of the present disclosure.
Figure 11A:
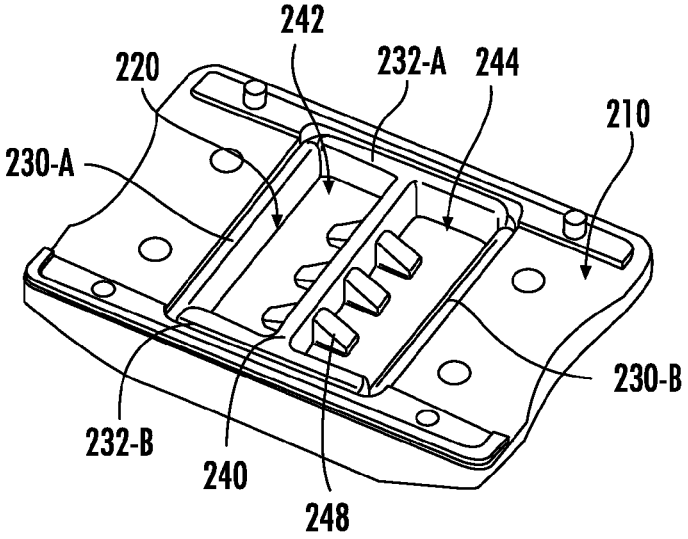
FIG. 11A is a top perspective view of the insert within a housing according to embodiments of the present disclosure.
Figure 11B:
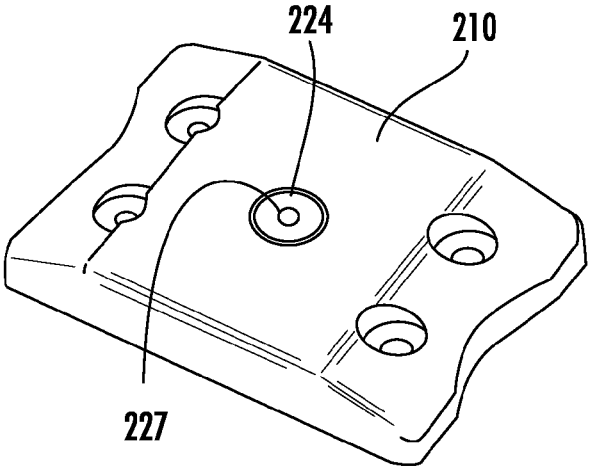
FIG. 11B is a bottom perspective view of the insert within the housing of FIG. 11A according to embodiments of the present disclosure.
Figure 12A:
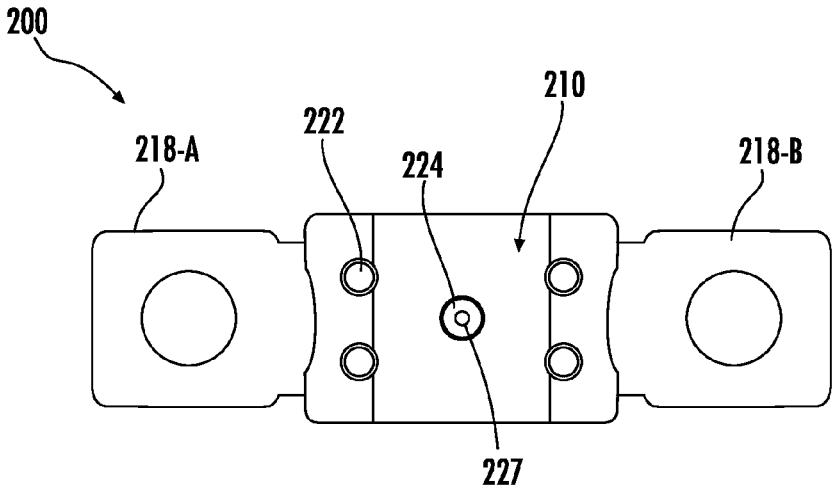
FIG. 12A is a top view of the fuse structure of FIG. 9 according to embodiments of the present disclosure.
Figure 12B:
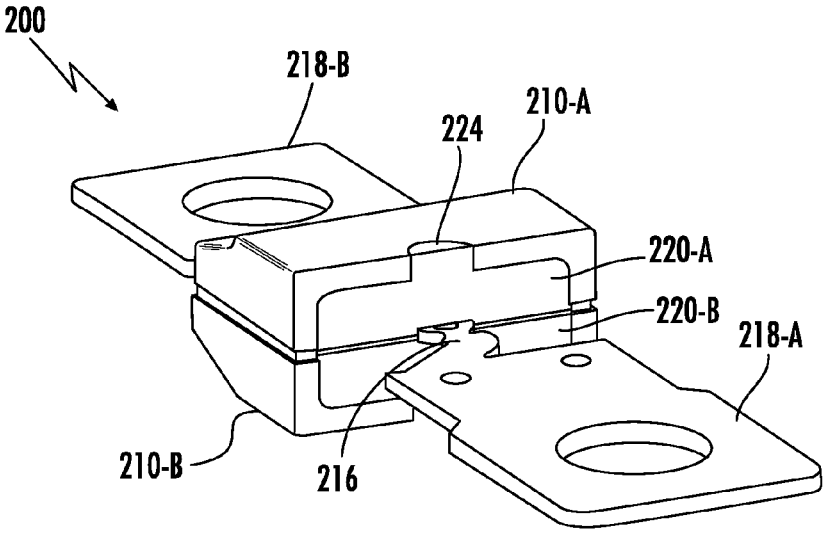
FIG. 12B is a perspective view of the fuse structure of FIG. 12A according to embodiments of the present disclosure.

As best shown in FIGS. 9 and 12B, the insert 220 includes a first section 220-A (e.g., a top half) and a second section 220-B (e.g., a bottom half) coupleable to one another to encase the fuse element 216 therebetween. As shown, the insert 220 is disposed above and below the fuse element 216, while the housing 210 is configured to center the insert 220 about the fuse element 216. During use, as best shown in FIG. 12B, the fuse element 216 is clamped between the first and second sections 220A-B of the insert 220. More specifically, the fuse element 216 is coupled between silicone inlays of the insert 220 in an area of tin pearl (tin pearl not shown in view). The first and second sections 210A-B of the housing 210 may be coupled together by welding, adhesive, or by rivets 222, for example, as shown in FIG. 9.

Furthermore, each of the first and second sections 220A-B of the insert includes a set of sidewalls 230A-B and a set of end walls 232A-B coupled to the set of sidewalls 230A-B. In this embodiment, the insert 220 further includes a separating wall 240 extending between the set of end walls 232A-B, for example, in a central portion of the insert 220. In some embodiments, the separating wall 240 includes one or more buttresses 248 extending perpendicularly therefrom, to provide additional support to the separating wall 240. As arranged, the separating wall 240, together with the end walls 232 and sidewalls 230, define a first cavity 242 and a second cavity 244 within the insert 220. It will be appreciated, in other embodiments, that any number of separating walls and cavities (e.g., 2-5 cavities) may be formed within the insert 220. The fuse element 216 is disposed within the insert 220, such that the fuse element 216 is disposed between the set of sidewalls 230A-B.

Advantageously, the fuse insert 220 separates the inside of the housing into multiple independent cavities 242, 244, which interrupts the conductive paths from one terminal 218-A to the other terminal 218-B after fuse opening (e.g., melting of the fuse element 216). Furthermore, the fuse insert 220 helps to extinguish the appearing arc during fuse opening, and to lower the amount of vaporized material. In other words, in the moment when the fuse opens, the silicone closes the gap around the fuse element 216 and the arc is interrupted. The closed gap and the fact that less copper material is vaporized results in an increase of the open state resistance.

Turning now to FIGS. 13-16B, a fuse insert according to another exemplary embodiment will be described in greater detail. As shown, a fuse 300 includes a housing 310 having a cavity 314 formed therein, and a fuse element 316 disposed within the cavity 314. The fuse 300 further includes a plurality of terminals 318A-B extending out of the housing 310 and electrically connected to the fuse element 316. The fuse 300 further includes an insert 320 disposed within the cavity 314. As shown, the plurality of terminals 318A-B includes first and second terminals, wherein the insert 320 is spaced apart/between the first and second terminals 318A-B.

In one embodiment, the insert 320 is a silicone material in direct touch with the melting fuse element 316, which becomes hot (e.g., 170° C. and higher) during overload conditions. As further shown, the insert 320 includes a pin 324 configured to extend through an opening 328 formed through the housing 310. During assembly, the pin 324 is inserted through the opening 328 in one or both portions of the housing 310, and serves as a visual indicator that the insert 320 is contained within the fuse 300.

Similar to above, the pin 324 may include an orifice 327 formed therein as a pressure release feature. The orifice 327 may be pre-formed through the pin 324, e.g., as a narrow channel that is closed in a normal state, expanding as pressure increases. In other embodiments, the orifice 327 is not preformed and, instead, is formed by virtue of the pin 324 rupturing as it expands through the opening 328 of the housing 310. The pin 324 may be dimensioned, e.g., with a particular sidewall thickness, to ensure that failure occurs at an intended pressure level.

Figure 13:
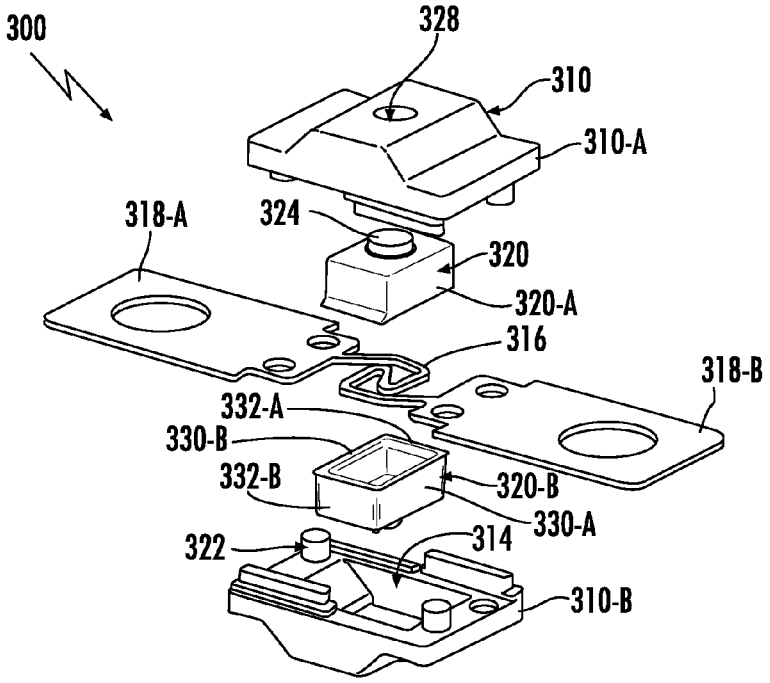
FIG. 13 is an exploded perspective view of an example fuse structure according to embodiments of the present disclosure.
Figure 14:
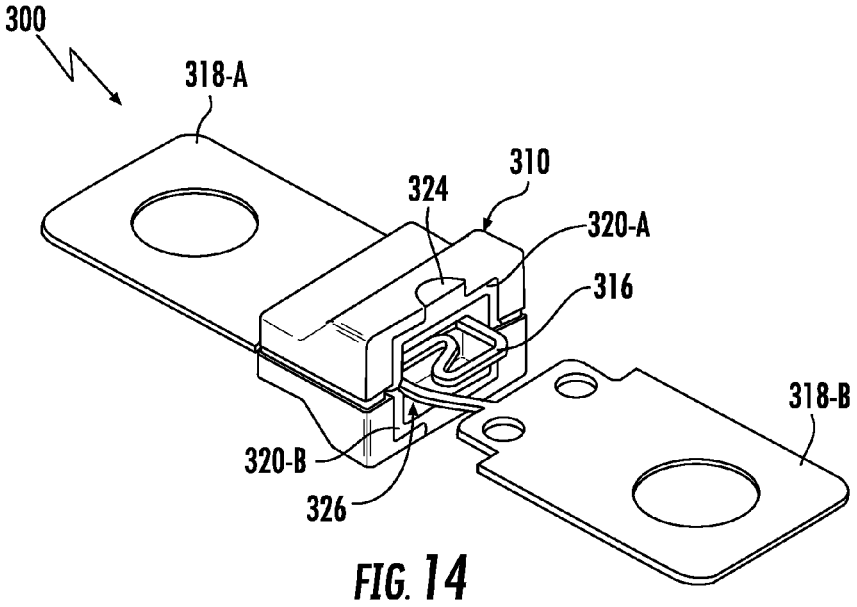
FIG. 14 is a perspective view of the fuse of FIG. 14, with a portion of the insert removed for clarity.
Figure 15A:
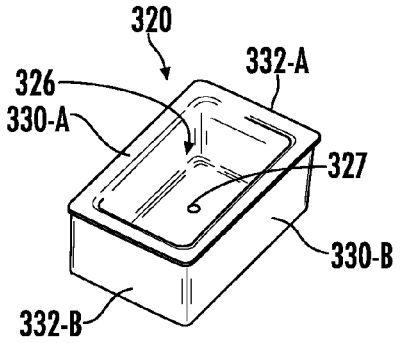
FIG. 15A is a top perspective view of an insert for use with a fuse according to embodiments of the present disclosure.
Figure 15B:
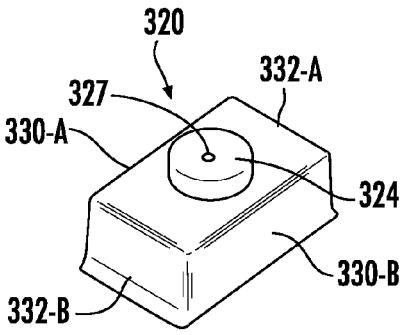
FIG. 15B is a bottom perspective view of the insert of FIG. 15A according to embodiments of the present disclosure.
Figure 16A:
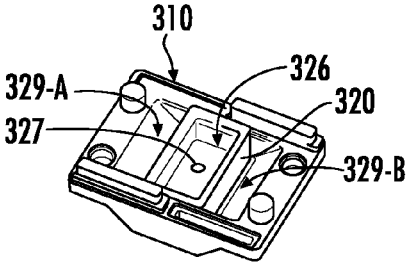
FIG. 16A is a top perspective view of the insert within a housing according to embodiments of the present disclosure.
Figure 16B:
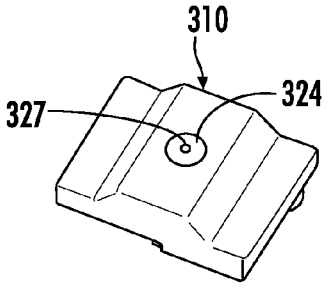
FIG. 16B is a bottom perspective view of the insert within the housing of FIG. 16A according to embodiments of the present disclosure.

As best shown in FIGS. 13 and 14, the insert 320 includes a first section 320-A (e.g., a top half) and a second section 320-B (e.g., a bottom half) coupleable to one another to encase the fuse element 316 within a cavity 326. As shown, the insert 320 is disposed above and below the fuse element 316, while the housing 310 is configured to center the insert 320 about the fuse element 316. The first and second sections 310A-B of the housing 310 may be coupled together by welding, adhesive, or a set of mating male/female members 322.

During use, the fuse element 316 is clamped between the first and second sections 320A-B of the insert 320. More specifically, the fuse element 316 is coupled between silicone inlays of the insert 320 in an area of tin pearl (tin pearl not shown). That is, the tin pearl is positioned in a central area of the fuse element 316, e.g., directly in the center of the cavity 326 formed by the insert 320.

Furthermore, each of the first and second sections 320A-B of the insert 320 includes a set of sidewalls 330A-B and a set of end walls 332A-B coupled to the set of sidewalls 330A-B, and defining the cavity 326. Although not shown, one or more separating walls may be included within the insert 320. Furthermore, although termed "sidewalls" and "end walls," it will be appreciated that the set of sidewalls 330A-B and the set of end walls 332A-B may themselves be considered separating walls defining, e.g., one or more additional cavities 329A-B (FIG. 16B) formed within the housing 310.

The fuse element 316 is disposed within the cavity 326 of the insert 320, such that the fuse element 316 is disposed between the set of sidewalls 330A-B and the set of end walls 332A-B. During use, in the moment where the fuse element 316 opens, the silicone of the insert 320 closes the gap left by the melted fuse element 316, and the arc is interrupted. The closed gap and the fact that less copper material is vaporized results in a significant increase of the open state resistance. Also a significant amount of vaporized material will stay in the inside of both silicone inlays, for example, within the cavity 326.

As used herein, references to "an embodiment," "an implementation," "an example," and/or equivalents is not intended to be interpreted as excluding the existence of additional embodiments also incorporating the recited features.

While the present disclosure has been made with reference to certain embodiments, numerous modifications, alterations and changes to the described embodiments are possible without departing from the sphere and scope of the present embodiments, as defined in the appended claim(s). Accordingly, the present disclosure is not to be limited to the described embodiments, but rather has the full scope defined by the language of the following claims, and equivalents thereof.

The invention claimed is:

1. A fuse, comprising:

a housing having a cavity;

a fuse element disposed within the cavity;

a plurality of terminals extending out of the housing and electrically connected to the fuse element; and an insert disposed in the cavity, the insert including a pin extending through an opening of the housing, the insert further including a first half and a second half coupled to one another to encase the fuse element therebetween, wherein a first juncture of the first half and the second half clamps the fuse element at a first location along a length of the fuse element and wherein a second juncture of the first half and the second half clamps the fuse element at a second location along a length of the fuse element.

2. The fuse of claim 1, wherein the insert comprises:

a set of sidewalls;

a set of end walls coupled to the set of sidewalls; and a separating wall extending between the set of end walls.

3. The fuse of claim 2, wherein the separating wall defines a first cavity of the insert and a second cavity of the insert.

4. The fuse of claim 2, wherein the insert comprises a buttress extending from the separating wall.

5. The fuse of claim 1, wherein the insert is silicone.

6. The fuse of claim 1, wherein the first half of the insert is disposed above the fuse element and the second half of the insert is disposed below the fuse element.

7. The fuse of claim 1, wherein the housing is configured to center the insert about the fuse element.

8. The fuse of claim 2, wherein the fuse element is disposed between the set of sidewalls.

9. The fuse of claim 1, wherein the plurality of terminals includes a first terminal and a second terminal, and wherein the insert is spaced apart from the first terminal and the second terminal.

10. The fuse of claim 1, wherein the housing comprises a first portion and a second portion.

11. A fuse, comprising:

a housing having a cavity;

a fuse element disposed within the cavity;

a plurality of terminals extending out of the housing and electrically connected to the fuse element; and a silicone insert disposed in the cavity, the insert defining a first cavity and a second cavity separated by a separating wall, the insert including a first half and a second half coupled to one another to encase the fuse element therebetween, wherein a first juncture of the first half and the second half clamps the fuse element at a first location along a length of the fuse element and wherein a second juncture of the first half and the second half clamps the fuse element at a second location along a length of the fuse element.

12. The fuse of claim 11, wherein the insert comprises:

a set of sidewalls; and a set of end walls coupled to the set of sidewalls, wherein the separating wall extends between the set of end walls.

13. The fuse of claim 12, wherein the fuse element is disposed between the set of sidewalls.

14. The fuse of claim 11, wherein the first half of the insert is disposed above the fuse element and the second half of the insert is disposed below the fuse element.

15. The fuse of claim 11, wherein the plurality of terminals includes a first terminal and a second terminal, and wherein the insert is spaced between the first terminal and the second terminal.

16. The fuse of claim 11, wherein the housing comprises a first portion and a second portion.

* * * * *